United States Patent [19]

Piipponen et al.

[11] Patent Number: 5,050,283

[45] Date of Patent: Sep. 24, 1991

[54] ARRANGEMENT FOR HANDLING DRILL RODS IN A ROCK DRILLING UNIT OR THE LIKE

[75] Inventors: Jusha Piipponen, Tampere; Pekka Heiskanen, Nokia; Juhani Lappalainen, Tampere; Kari Färlin, Siivikkala; Pekka Salmi, Tampere, all of Finland

[73] Assignee: Oy Tampella Ab, Tampere, Finland

[21] Appl. No.: 494,748

[22] Filed: Mar. 19, 1990

[30] Foreign Application Priority Data

Mar. 23, 1989 [FI] Finland ..... 891418

[51] Int. Cl.[5] ..... B25B 13/50

[52] U.S. Cl. ..... 29/240

[58] Field of Search ..... 29/240, 281.4, 281.5; 269/17, 45, 43, 130, 296; 254/29 R, 30; 81/57.34, 57.39

[56] References Cited

U.S. PATENT DOCUMENTS 1,875,761 9/1932 Power ..... 269/45
4,024,925 5/1977 Brown .
4,092,881 6/1978 Jurgens et al. ..... 29/240
4,295,257 10/1981 Strohs ..... 29/240
4,843,702 7/1989 Charest ..... 269/45

*Primary Examiner*—Robert C. Watson
*Attorney, Agent, or Firm*—Nixon & Vanderhye

[57] ABSTRACT

An arrangement for handling a drilling equipment comprising clamping jaws (11*a*, 11*b*) mounted rotatably with respect to the axis of a drill tube (8*a*, 8*b*) and a breaking device (7) mounted rotatably about the axis of the drill tube (8*a*, 8*b*) and movably in the longitudinal direction of a feed beam (3), which breaking device can be connected to the drill tube (8*a*, 8*b*) or the like unrotatably with respect thereto. To move the drill tube (8*a*, 8*b*) or the like to the drilling position and away from it, respectively, the breaking device (7) is mounted turnably about an axis transverse to the longitudinal axis of the feed beam (3), which makes it possible to push the horizontal tube (8*b*) or the like into the breaking device (7) turned to the direction transverse to the feed beam (3) and to fasten it to the breaking device, after which the tube (8*b*) can be turned into a drilling center between a rotating mechanism (5) and the previous drill tube (8*a*) by moving the breaking device (7) along the feed beam (3).

17 Claims, 3 Drawing Sheets

ARRANGEMENT FOR HANDLING DRILL RODS IN A ROCK DRILLING UNIT OR THE LIKE

Figure 1:
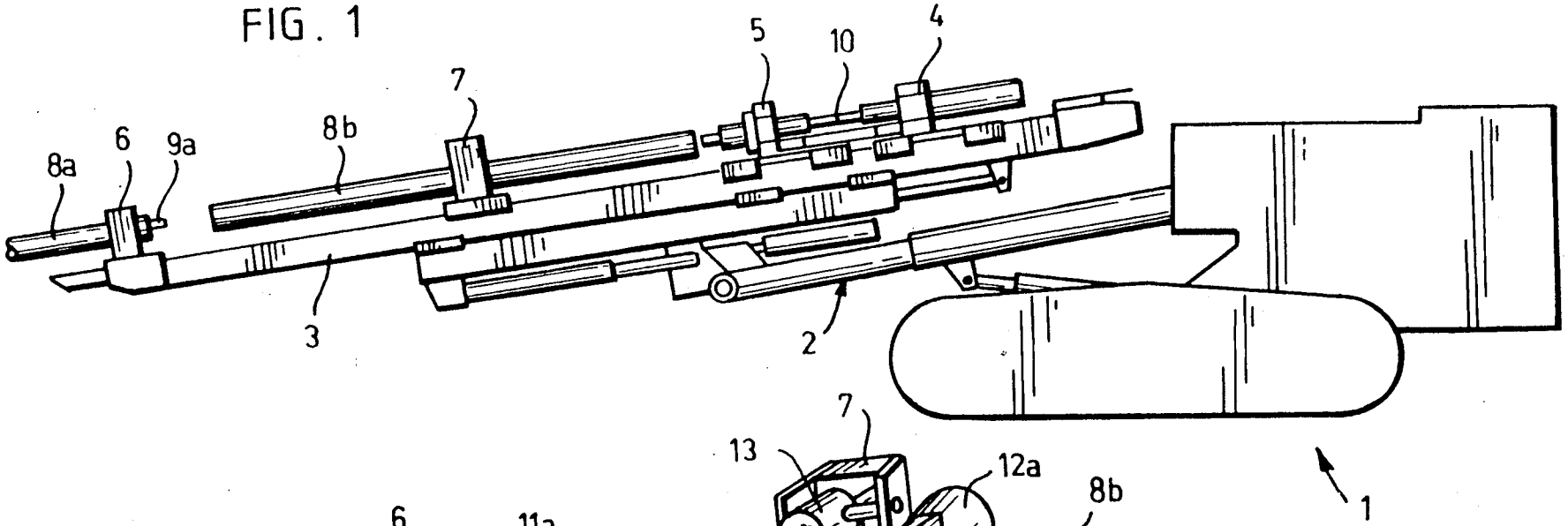

The invention relates to an arrangement for handling drill rods or the like in a rock drilling unit or the like, the arrangement comprising a breaking device displaceable along a feed beam of a drilling machine, which breaking device comprises an opening for the drill rod and at least one clamping element for retaining the drill rod immobile in its longitudinal direction with respect to the breaking device at least during breaking a thread.

In rock drilling units and in drilling units working in a similar manner, drill tubes and rods to be fastened to each other by means of a threaded joint are used for drilling holes deeper than the length of the feed beam of the units. It is rather uncomfortable and heavy to handle heavy drill rods and respective drill tubes as well as drill rods provided with casings and used especially at earth drilling, and besides, plenty of manpower is required. In order that rods and tubes at all could be handled by manpower, the drill rods and/or tubes are relatively short to keep the weight as small as possible. Further, for breaking threaded joints of a drilling equipment, solutions are used comprising a retaining pair of jaws on one side of the joint to be broken and on the other side a breaking device provided with jaws clamping to the tube or drill rod, whereby the jaws on both sides of the joint are clamped to the rod and the upper rod is rotated by the breaking device in such a way that the joint is broken. Such a solution is known e.g. from the British Patent 1 309 399 comprising a breaking device movable in the direction of the feed beam of the drilling unit. In this breaking device, fixed jaws and rotatable breaking jaws are united into one stationary unit. In the solution of the above publication, the drill tubes and/or rods shall either be lifted manually to the drilling position or mounted on a separate rack parallel to the feed beam in order that they can be moved to the drilling axis, when necessary. This requires extra work and retards the drilling remarkably because of the fact that the rack transportable with the feed beam has a restricted capacity and must be reloaded.

In solutions with no separate rotatable jaw structure intended for breaking, the joints must be broken by means of separate keys and other tools used by manpower, which is heavy and uncomfortable and often causes risk situations. Moreover, a tube or rod equipment is easily damaged when broken in this way, because it must often be hit with a hammer or some other tool of that kind to loosen the joint to enable a manual breaking on the whole.

The object of this invention is to provide such an arrangement for handling a drilling equipment which makes it possible to mount drill tubes and/or rods easily and by little manpower in place for drilling and to disengage them, respectively, and in which arrangement it is not necessary to store drill rods and/or tubes in a cassette movable together with the feed beam, but a necessary amount of them can be kept easily available. This is provided according to the invention in such a manner that the breaking device is mounted turnably about an axis transverse to the longitudinal axis of the feed beam in such a way that a drill rod or the like can be placed in an opening of the breaking device or removed from there in a direction transverse to the feed beam and that at least one clamping element of the breaking device can be arranged to retain the drill rod also when the breaking device is turned into the direction transverse to the feed beam.

The basic idea of the invention is that the breaking device with jaws to be arranged to retain the drill rod or the like and to be rotated about the axis thereof is mounted turnably about an axis transverse to the drilling axis, whereby the breaking device can be turned transverse to the drilling direction and the drill rod or the like can be pushed e.g. along a roll table between the jaws of the breaking device, after which the drill rod or the like is clamped by jaws to the breaking device and by moving the breaking device along the feed beam to its rear part the drill rod is placed at a place desired and after that or simultaneously with the displacement turned parallel to the feed beam to form an extension of the previous rod, after which it can be fastened thereto and the drilling can go on. On the other hand, when disengaging the drilling equipment the breaking device is fastened to the drill rod and after the joint has been broken the drill rod can be turned to the direction transverse to the feed beam and then drawn out of the breaking device. According to the solution of the invention the drill rod can be handled fully mechanically without using manpower to carry out the heavy work, and then the rod length to be used in each particular case can be chosen so as to be advantageous for the drilling and the drilling unit without needing to pay attention to the restricted lifting capacity of man. Thus, to begin with, the joining and breaking time needed for the extension or disengagement of the drilling equipment is shortened, and additionally, the whole breaking operation can be attended to in such a way that always the joint desired is broken. In this application and the claims, the drill rod or the like means drill rods, drill tubes, drill rods provided with casings and all rod-like or tube-like components used for a purpose of this kind.

The invention is described in greater detail in the drawings enclosed, in which

Figure 2:
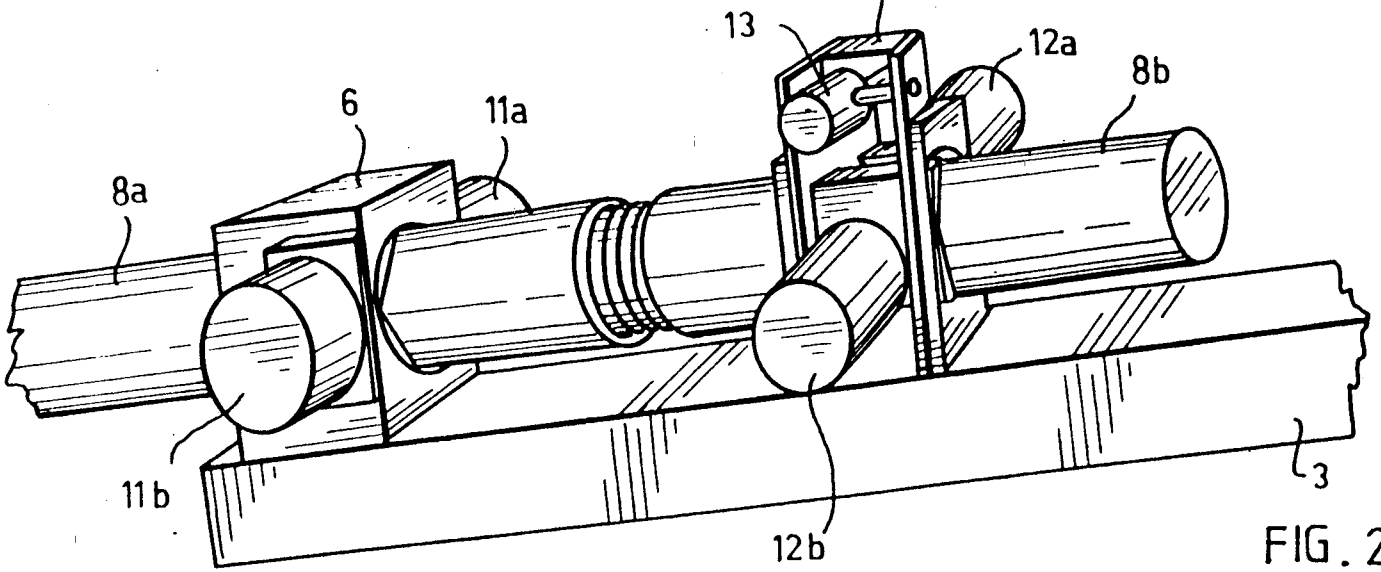
Figure 3:
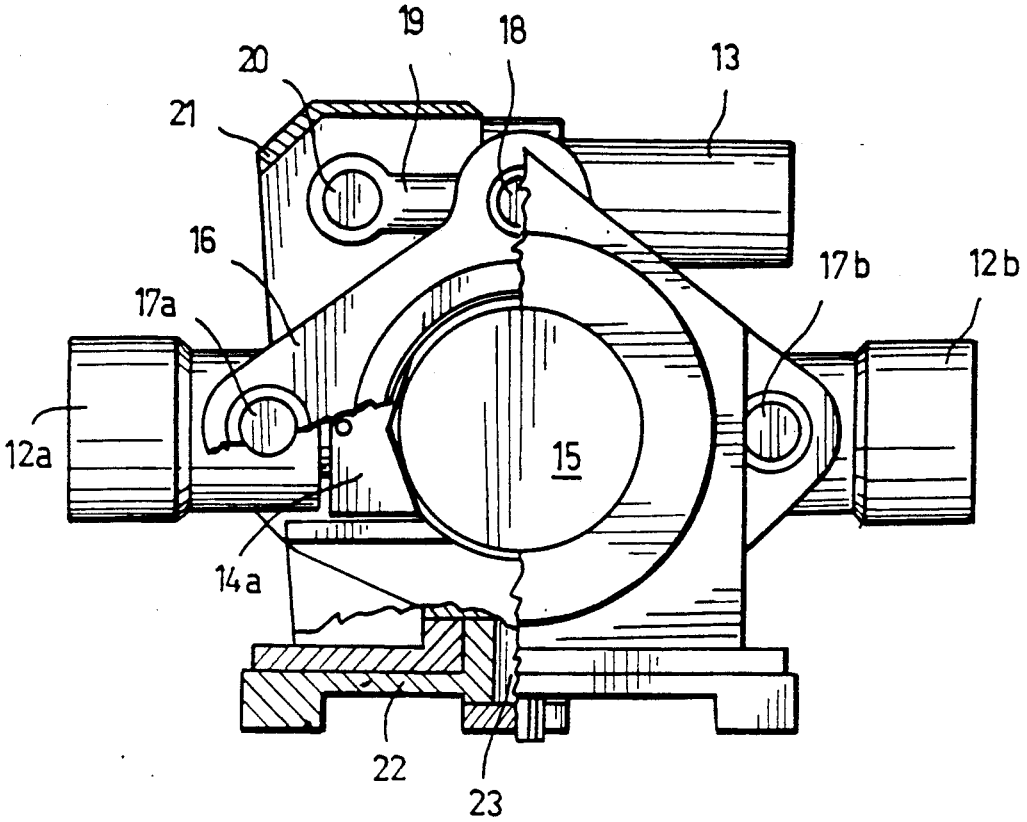
Figures 4A, 4B, 4C:
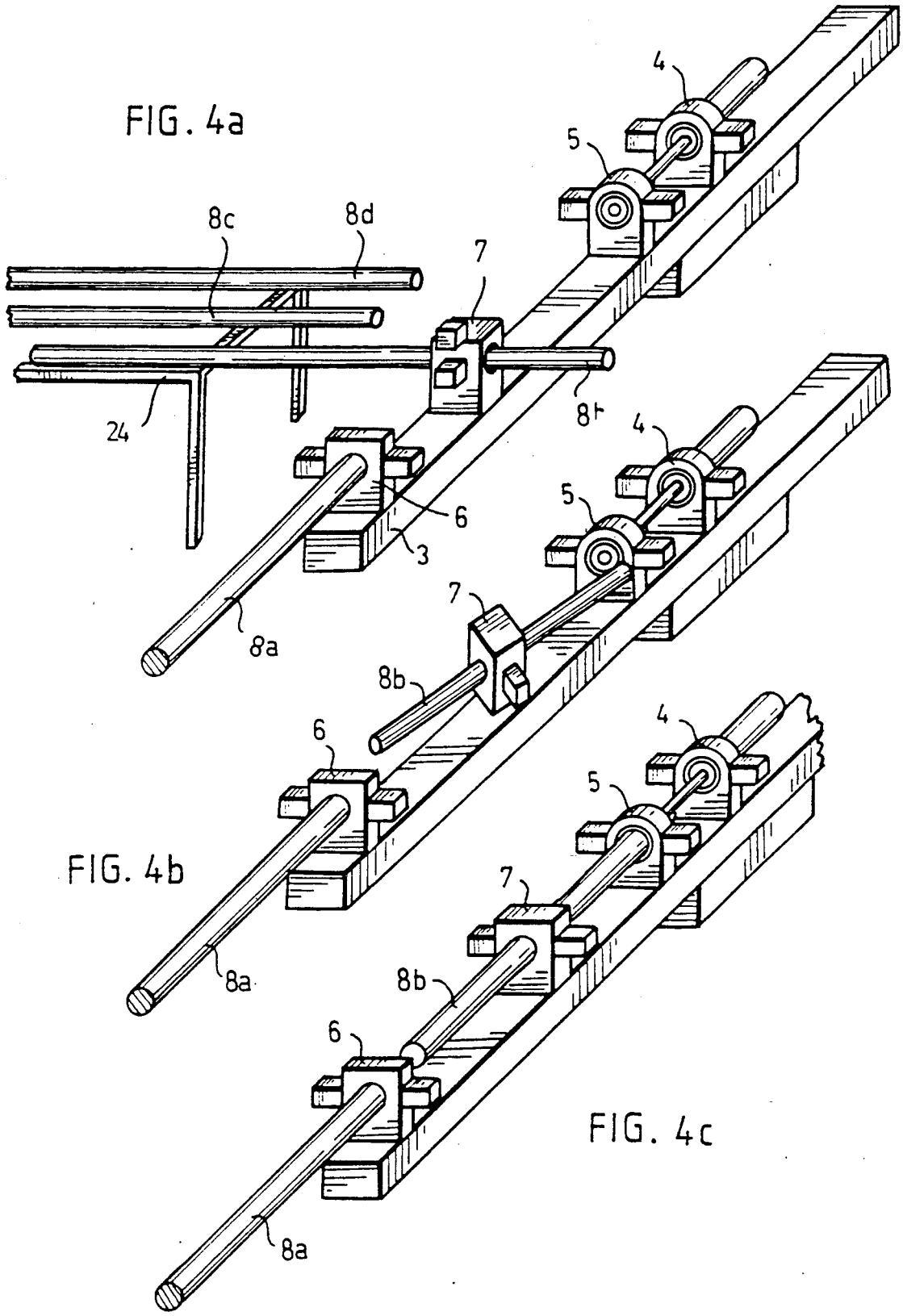

FIG. 1 shows schematically an equipment according to the invention mounted in a drilling unit intended for drilling with a casing, FIG. 2 shows the equipment of the invention more closely, FIG. 3 shows an embodiment of a breaking device of the equipment of the invention and FIGS. 4*a*–4*c* show schematically how a drill rod or the like is connected with a previous drill equipment.

FIG. 1 shows schematically a drilling carrier 1 provided with a feed beam 3 fastened to a boom 2. The structure and operation thereof are generally fully known, and therefore, they are not described more accurately. On the feed beam 3, there is a drilling machine 4 movable in the longitudinal direction with respect to the feed beam and in front of the drilling machine there is a rotating motor 5. At the front end of the feed beam there is a drill steel centralizer and retainer 6 and between that and the rotating motor 5 there is a breaking device 7 movable along the feed beam 3.

The arrangement of FIG. 1 is an earth drilling equipment comprising drill rods 9 provided with casings 8. In the situation of the figure, a first tube 8*a* and rod 9*a* are retained by the retainer 6 and a second tube 8*b*, inside which there is another invisible rod, is supported by the breaking device 7. A drill axis 10 of the drilling machine 4 passes through a tube-like 5 axis of the rotating motor and then the drill axis can be fastened to the drill rod 9 and the axis of the rotating motor to the tube 8, respectively.

FIG. 2 shows the retainer 6 and the breaking device 7 more accurately in a situation when a joint between the two tubes 8*a* and 8*b* just has been broken. The retainer comprises two hydraulic cylinders 11*a* and 11*b*, to the pistons of which have been mounted in a manner known per se clamping jaws not shown. When the cylinders 11*a* and 11*b* are fed with pressure fluid, the jaws are clamping around the tube 8*a* and prevent it from moving with respect to the retainer 6 both in the rotating direction and in the axial direction. The breaking device 7 comprises pressure cylinders 12*a* and 12*b* provided with clamping jaws, respectively, and by leading pressure fluid into the pressure cylinders the second tube 8*b* can be made immobile with respect to the jaws of the breaking device. The breaking device 7 further has a breaking cylinder 13 and by feeding pressure fluid into this breaking cylinder the pressure cylinders 12*a* and 12*b* as well as the tube 8*b* can be brought into rotation about their axis. When breaking the joint, the pressure cylinders 11*a*, 11*b* and 12*a*, 12*b*, respectively, of both the retainer 6 and the breaking device 7 are arranged to press their proper tube 8*a* and 8*b*, respectively, on the different sides of the threaded joint. After this, pressure fluid is led into the breaking cylinder of the breaking device 7, which brings its pressure cylinders 12*a* and 12*b* and together with them the tube 8*b* into rotation with respect to the tube 8*a* and the threaded joint is broken. After this, the rest of the threaded joint can be unscrewed by means of the rotating motor 5.

FIG. 3 shows the breaking device 7 partially in section in greater detail. The pressure cylinders 12*a* and 12*b* comprise clamping jaws, from which a jaw 14*a* mounted on the pressure cylinder 12*a* can be seen. In the middle part of the breaking device there is an opening 15, through which the tubes 8 can be pushed into the breaking device. The breaking device further comprises an auxiliary body 16 rotatably mounted about the axis of the opening 15, on which auxiliary body the pressure cylinders 12*a* and 12*b* are mounted by means of journals 17*a* and 17*b*, respectively. The breaking cylinder 13 is mounted on the auxiliary body 16 by means of a journal 18 and its piston 19 again is mounted by means of a journal 20 on the body 21 of the breaking device 7. Moreover, the body 21 is mounted by means of an axle journal 23 rotatably about an axis transverse to the axis of the opening 15 (by a power unit 27) and thus also of the tubes 8 and the drill rods 9 on a drill carriage 22 moving along the feed beam 3. The breaking device 7 can thus be turned in such a way that the axis of the opening 15 is parallel to the axes of the feed beam 3 and then also of the drill tubes 8 and the drill rods 9 during drilling and when mounting or removing tubes as desired it is in the direction transverse to the axis of the feed beam.

The FIGS. 4*a* to 4*c* show schematically how a new drill tube is mounted to continue drilling. In FIG. 4*a*, the breaking device 7 is turned transverse to the feed beam 3, and then, the tube 8*b* preferably on a table 24 provided with rolls can be pushed in through the opening 15 of the breaking device 7. After this, the pressure cylinders 12*a* and 12*b* are arranged to press the tube 8*b* and it is going to be moved along the feed beam towards the drilling machine 5. Simultaneously, the breaking device 7 is turned about the axle journal 23, which makes the tube 8*b* turn parallel to the feed beam 3. When the tube 8*b* is at a suitable place in the longitudinal direction of the feed beam 3 and parallel thereto, it is moved by means of the breaking device 7 to be fastened to the previous tube 8*a*, the clamping jaws 12*a* and 12*b* are opened and the tube is screwed up by means of the rotating motor 5 and the drilling machine 4 in a manner known per se. When disengaging drill tubes, the operation is carried out in the reverse order, but at first the threaded joints are broken in the manner described previously.

The above description and the drawings enclosed describe only some possible embodiments of the invention and the invention is by no means restricted to them. The structure and operation of the breaking device can consist of any known solution, if only the tube or the like can be rotated about its longitudinal axis by means of the breaking device mentioned and it is mounted turnably about the axis transverse to the longitudinal direction of the feed beam. Instead of a breaking device turnable by manpower about the transverse axis, a solution can be used, according to which the breaking device is turned by means of a power unit, as a hydraulic cylinder or the like, in which case, especially when disengaging, turning the tube or the like is safer and less manpower is required. The invention can be used as such, both when handling only tubes or rods and when handling rods with casings. Further, the jaws mounted unrotatably can either be mounted stationarily or they can be mounted movable for instance in the longitudinal direction of the feed beam.

We claim:

1. In a rock drilling unit having a feed beam movable along a longitudinal axis, apparatus for handling drill rods comprising:

a breaking device displaceable along the feed beam of the drilling unit, said breaking device including a body having an opening for the drill rod and at least one clamping element for retaining the drill rod immobile in its longitudinal direction with respect to the breaking device at least during breaking of a thread on the drill rods;

means mounting said breaking device for rotation about an axis transverse to the longitudinal axis of the feed beam to enable a drill rod for disposition in and removal from said opening of the breaking device in a direction transverse to the longitudinal axis of the feed beam;

said at least one clamping element of said breaking device being operable to retain the drill rod clamped in said breaking device when said breaking device is turned into a direction to align the drill rod carried thereby parallel to the feed beam.

2. Apparatus according to claim 1 wherein said breaking device is movable longitudinally along the feed beam a predetermined distance, said breaking device being turnable in the direction transverse to the feed beam substantially throughout said predetermined distance.

3. Apparatus according to claim 1 wherein said breaking device is provided with a power unit for rotating said breaking device about the transverse axis relative to the feed beam.

4. Apparatus according to claim 1 wherein said breaking device body is mounted for movement longitudinally along the feed beam, an auxiliary body carried by said breaking device body for rotation about an axis parallel to said longitudinal axis when the breaking device is turned in the direction to align the drill rod carried thereby parallel to the feed beam, said at least one clamping element being carried by said auxiliary body for rotation therewith about said parallel axis, and means cooperable between said breaking device body and said auxiliary body for rotating said auxiliary body relative to said breaking device body for rotating the drill rod clamped within the breaking device.

5. Apparatus according to claim 4 wherein said cooperable means includes a piston and cylinder coupled between said breaking device body and said auxiliary body.

6. Apparatus according to claim 1 including a retainer carried by the feed beam and spaced longitudinally therealong from said breaking device, said retainer having an opening in axial alignment with the opening in said breaking device, when said breaking device is turned in said direction, for receiving and holding a second drill rod, said breaking device being rotatable about said transverse axis between positions axially aligning and misaligning said openings.

7. An arrangement according to claim 1 wherein the breaking device is provided with a power unit for turning it about its axis transverse to the feed beam.

8. In a rock drilling unit having a feed beam movable along a longitudinal axis, apparatus for handling drill rods, comprising:

a breaking device displaceable along the feed beam of the drilling unit, said breaking device including a body having an opening defining a first axis and for receiving in said opening a drill rod substantially coaxially therewith, said body carrying at least one clamping element for retaining the drill rod immobile in said opening and substantially coaxial with said first axis;

means mounting said breaking device for rotating about an axis transverse to the longitudinal axis of the feed beam between a first position with said first axis non-parallel to said longitudinal axis and a second position with said first axis parallel to said longitudinal axis, thereby enabling disposition of a drill rod in and removal of a drill rod from said opening of the breaking device when said breaking device lies in said first position thereof;

said at least one clamping element of said breaking device being operable to retain the drill rod clamped in said breaking device when said breaking device lies in said second position.

9. Apparatus according to claim 8 wherein said breaking device is movable longitudinally along the feed beam a predetermined distance, said breaking device being rotatable in the direction transverse to the feed beam substantially throughout said predetermined distance.

10. Apparatus according to claim 8 including a power unit for rotating said breaking device about said transverse axis relative to the feed beam.

11. Apparatus according to claim 8 wherein said breaking device body is mounted for movement longitudinally along the feed beam, an auxiliary body carried by said breaking device body for rotation about an axis parallel to said first axis, said at least one clamping element being carried by said auxiliary body for rotation therewith about said first axis, and means cooperable between said breaking device body and said auxiliary body for rotating said auxiliary body relative to said breaking device body for rotating the drill rod clamped within the breaking device.

12. Apparatus according to claim 11 wherein said cooperable means includes a piston and cylinder coupled between said breaking device body and said auxiliary body.

13. Apparatus according to claim 8 including a retainer carried by the feed beam and spaced longitudinally therealong from said breaking device, said retainer having an opening in axial alignment with said first axis when said breaking device lies in said second position for receiving and holding a second drill rod.

14. In rock drilling unit having a feed beam movable along a longitudinal axis, apparatus for handling drill rods, comprising:

a breaking device displaceable along the feed beam of the drilling unit, said breaking device including a body having an opening defining a first axis and for receiving in said opening a drill rod substantially coaxially therewith, said body carrying at least one clamping element for retaining the drill rod immobile in said opening and substantially coaxial with said first axis;

means mounting said breaking device for movement between a first position with said first axis non-parallel to said longitudinal axis and a second position with said first axis parallel to said longitudinal axis, thereby enabling disposition of a drill rod in and removal of a drill rod from said opening of the breaking device when said breaking device lies in said first position thereof;

said at least one clamping element of said breaking device being operable to retain the frill rod clamped in said breaking device when said breaking device lies in said second position.

15. Apparatus according to claim 14 wherein said breaking device body is mounted for movement longitudinally along the feed beam, an auxiliary body carried by said breaking device body for rotation about an axis parallel to said first axis, said at least one clamping element being carried by said auxiliary body for rotation therewith about said first axis, and means cooperable between said breaking device body and said auxiliary body for rotating said auxiliary body relative to said breaking device body for rotating the drill rod clamped within the breaking device.

16. Apparatus according to claim 15 wherein said cooperable means includes a piston and cylinder coupled between said breaking device body and said auxiliary body.

17. Apparatus according to claim 15 including a retainer carried by the feed beam and spaced longitudinally therealong from said breaking device, said retainer having an opening in axial alignment with the opening in said breaking device, when said breaking device lies in said second position for receiving and holding a second drill rod, said breaking device being movable between positions axially aligning and misaligning said openings.

* * * * *